US008793877B2

(12) United States Patent
Kim et al.

(10) Patent No.: US 8,793,877 B2
(45) Date of Patent: Aug. 5, 2014

(54) APPARATUS FOR MANUFACTURING TRUSS STRUCTURE USING MULTI-POINT PINS, METHOD OF MANUFACTURING TRUSS STRUCTURE USING THE SAME, TRUSS CORE SANDWICH PANEL HAVING THE TRUSS STRUCTURE, METHOD OF MANUFACTURING THE TRUSS CORE SANDWICH PANEL

(75) Inventors: Sang Woo Kim, Gyeongnam (KR); Daeyong Kim, Gyeongnam (KR); Ji Hoon Kim, Gyeongnam (KR); Youngseon Lee, Gyeongnam (KR); Yong Nam Kwon, Gyeongnam (KR); Seong Hoon Kang, Gyeongnam (KR); Kwang Seok Lee, Gyeongnam (KR)

(73) Assignee: Korea Institute of Machinery and Materials, Daejon (KR)

( * ) Notice: Subject to any disclaimer, the term of this patent is extended or adjusted under 35 U.S.C. 154(b) by 234 days.

(21) Appl. No.: 13/369,616

(22) Filed: Feb. 9, 2012

(65) Prior Publication Data

US 2012/0263969 A1 Oct. 18, 2012

(30) Foreign Application Priority Data

Apr. 15, 2011 (KR) ..... 10-2011-0035289

(51) Int. Cl.
*B21D 47/00* (2006.01)

(52) U.S. Cl.
USPC ..... 29/897.31; 72/385; 72/473; 72/474

(58) Field of Classification Search
CPC B21D 47/00; B21D 47/04; E04C 2003/0486; E04C 2003/0491; E04C 2003/0495
USPC ..... 29/897.31, 897, 897.312; 72/375, 385, 72/386, 389.1, 470, 473, 474
See application file for complete search history.

(56) References Cited

U.S. PATENT DOCUMENTS 3,884,646 A * 5/1975 Kenney ..... 428/593
3,961,738 A * 6/1976 Ollman ..... 228/5.1
6,644,535 B2 11/2003 Wallach et al.

(Continued)

FOREIGN PATENT DOCUMENTS

KR 1020060007934 A 1/2006
KR 1020060066766 A 6/2006

(Continued)

OTHER PUBLICATIONS

Kang, Ki Ju et al., English Abstract of KR Publication No. 1020060007934; 1 page.
Sung, Si Young et al., English Abstract of KR Publication No. 1020110024065; 1 page.

*Primary Examiner* — Ryan J Walters
(74) *Attorney, Agent, or Firm* — Fredrikson & Byron, PA

(57) ABSTRACT

The present invention provides an apparatus for manufacturing a truss structure using multi-point pins, a method of manufacturing a truss structure using the apparatus, a truss core sandwich panel having the truss structure, and a method of manufacturing the truss core sandwich panel. The apparatus includes a metal plate, clamps, an upper die and a lower die. The clamps hold the metal plate. The upper die has upper multi-point pins which press the metal plate downwards. The lower die has lower multi-point pins which press the metal plate upwards. The metal plate has first and second points that respectively correspond to the upper and lower multi-point pins. The first points are extended downwards by the upper multi-point pins, and the second points are extended upwards by the lower multi-point pins. Thereby, many symmetrical sides are formed in the truss structure, thus increasing the stability of the truss structure.

9 Claims, 23 Drawing Sheets

(56) References Cited

U.S. PATENT DOCUMENTS

| | | | | |
|---|---|---|---|---|
| 7,288,326 | B2 | 10/2007 | Elzey et al. | |
| 7,424,967 | B2 | 9/2008 | Ervin et al. | |
| 8,220,155 | B2 * | 7/2012 | Weber et al. | 29/897.2 |

FOREIGN PATENT DOCUMENTS

| | | | |
|---|---|---|---|
| KR | 100738502 | B1 | 7/2007 |
| KR | 100767186 | B1 | 10/2007 |
| KR | 1020100021174 | A | 2/2010 |

* cited by examiner

APPARATUS FOR MANUFACTURING TRUSS STRUCTURE USING MULTI-POINT PINS, METHOD OF MANUFACTURING TRUSS STRUCTURE USING THE SAME, TRUSS CORE SANDWICH PANEL HAVING THE TRUSS STRUCTURE, METHOD OF MANUFACTURING THE TRUSS CORE SANDWICH PANEL

CROSS-REFERENCES TO RELATED APPLICATION

This patent application claims the benefit of priority under 35 U.S.C. §119 from Korean Patent Application No. 10-2011-0035289 filed on Apr. 15, 2011, the contents of which are incorporated herein by reference.

BACKGROUND OF THE INVENTION

1. Field of the Invention

The present invention relates generally to apparatuses for manufacturing truss structures using multi-point pins, methods of manufacturing truss structures using the apparatuses, truss core sandwich panels having the truss structures and methods of manufacturing the truss core sandwich panels and, more particularly, to an apparatus for manufacturing a truss structure using multi-point pins, a method of manufacturing a truss structure using the apparatus, a truss core sandwich panel having the truss structure, and a method of manufacturing the truss core sandwich panel, in which the heights of the multi-point pins can be adjusted so that a truss core sandwich panel can be manufactured in a variety of cross-sectional shapes, and in which the strength of the structure can be enhanced by strain hardening thanks to a tensioning process.

2. Description of the Related Art

Generally, sandwich panels are structures which have an intermediate layer including a porous substance made of material such as foamed metal of a low density or a grid-shaped substance such as a honeycomb substance, while substances having comparatively high strength and density are applied to upper and lower sides of the intermediate layer. Thus, the weight of the intermediate layer per unit area is reduced, but the strength of the structure is comparatively high. A porous open truss structure is for example used as the intermediate layer of such a sandwich panel.

The truss structure is advantageous in that the open internal space thereof can be utilized for various purposes. The design of the truss structure must provide the maximum strength and rigidity.

Meanwhile, conventional methods of manufacturing the truss structure are classified into a method including making a three-dimensional resin truss structure and investment-casting metal using the resin truss structure as a die, and a method including regularly perforating a plate to form a two-dimensional net shape and bending the net-shaped plate.

The former method requires high production cost, and the manufacturing process is not continuous. Furthermore, there is a disadvantage in that the nature of the casting makes it easy to cause internal flaws. The latter method can produce products continuously, but there is a great loss of material and it is difficult to manufacture different shapes of sandwich panels because the method can produce only truss structures having the same height.

SUMMARY OF THE INVENTION

Accordingly, the present invention has been made keeping in mind the above problems occurring in the prior art, and an object of the present invention is to provide an apparatus for manufacturing a truss structure using multi-point pins, a method of manufacturing a truss structure using the apparatus, a truss core sandwich panel having the truss structure, and a method of manufacturing the truss core sandwich panel, in which the heights of the multi-point pins can be adjusted so that different shapes of truss core sandwich panels can be manufactured.

Another object of the present invention is to provide an apparatus for manufacturing a truss structure using multi-point pins, a method of manufacturing a truss structure using the apparatus, a truss core sandwich panel having the truss structure, and a method of manufacturing the truss core sandwich panel, in which the strength and rigidity of the structure can be enhanced by strain hardening thanks to a tensioning process, and the rate of recovery of material can be enhanced.

In order to accomplish the above object, in an aspect, the present invention provides an apparatus for manufacturing a truss structure using multi-point pins, including a metal plate having an outer frame and a plurality of perforations formed inside the outer frame, the perforations having a same shape, clamps pressing upper and lower sides of the outer frame to hold the metal plate, an upper die comprising: an upper plate, and a plurality of upper multi-point pins arranged under a lower surface of the upper plate in series in rows and columns, the upper die pressing the metal plate downwards, and a lower die comprising: a lower plate, and a plurality of lower multi-point pins arranged on an upper surface of the lower plate in series in rows and columns, the lower die pressing the metal plate upwards. The metal plate includes a plurality of first points formed at positions that vertically correspond to the upper multi-point pins, and a plurality of second points formed at positions that vertically correspond to the lower multi-point pins. The first points are extended downwards by pressure applied thereto from the upper multi-point pins, and the second points are extended upwards by pressure applied thereto from the lower multi-point pins, whereby a plurality of sides that are symmetrical around the first and second points are formed in the truss structure so that a shape of the truss structure is stable.

The upper plate or the lower plate may have a stepped shape so that heights of ends of the upper multi-point pins or lower multi-point pins differ from each other.

The upper plate may have a curved shape that is convex downwards or the lower plate may have a curved shape that is convex upwards so that heights of ends of the upper multi-point pins or lower multi-point pins differ from each other.

The upper plate may comprise a plurality of upper plates supporting the respective upper multi-point pins, or the lower plate may comprise a plurality of lower plates supporting the respective lower, whereby heights of ends of the upper multi-point pins or lower multi-point pins are individually adjusted.

Furthermore, each of the perforations may have a rhombic shape.

In addition, each of the perforations may have a rectangular shape.

Further, each of the perforations may have a hexagonal shape.

Each of the perforations may have a triangular shape.

In another aspect, the present invention provides a method of manufacturing a truss structure using multi-point pints, including machining a metal plate in a two-dimensional net shape by forming perforations having a same shape in the metal plate, clamping the metal plate by pressing upper and lower sides of an outer frame of the metal plate using clamps, and forming a truss structure in a three-dimensional shape by pressing the metal plate using the upper dies and the lower die of the truss structure manufacturing apparatus. The forming the truss structure includes extending the first points of the metal plate downwards by pressing the metal plate using the upper multi-point pins of the upper die, and extending the second points of the metal plate upwards by pressing the metal plate using the lower multi-point pins, whereby a plurality of sides that are symmetrical based on the first and second points are formed in the truss structure so that a shape of the truss structure is stable.

In a further aspect, the present invention provides a truss core sandwich panel manufactured by using multi-point pins, including a truss structure manufactured by the truss structure manufacturing method, an upper panel and a lower panel respectively disposed on and under the truss structure, and a bonding means for bonding upper and lower ends of the truss structure to the upper panel and the lower panel.

The truss structure may comprise a plurality of truss structures stacked one on top of another in a two or more layered shape to form a three-dimensional porous structure, or the truss core sandwich panel may comprise a plurality of truss core sandwich panels stacked one on top of another in a two or more layered shape to form a multi-layered sandwich panel structure.

In yet another aspect, the present invention provides a method of manufacturing a truss core sandwich panel using multi-point pins, including the machining the metal plate, the clamping the metal plate and the forming the truss structure of the truss structure manufacturing method, disposing an upper panel and a lower panel on and under the truss structure formed at the forming the truss structure, and bonding upper and lower ends of the truss structure to the upper panel and the lower panel using bonding means.

As described above, the present invention, in its various embodiments provides an apparatus for manufacturing a truss structure using multi-point pins, a method of manufacturing a truss structure using the apparatus, a truss core sandwich panel having the truss structure, and a method of manufacturing the truss core sandwich panel. In some embodiments of the present invention, different shapes of truss core sandwich panels can be manufactured by adjusting the heights of the multi-point pins. Strain hardening by a tensioning process can enhance the strength and rigidity of the structure. In addition, the structural stability of the structure can be enhanced by increasing the number of symmetrical sides of the structure. Further, the rate of recovery of material can be markedly increased, compared to the conventional technique.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
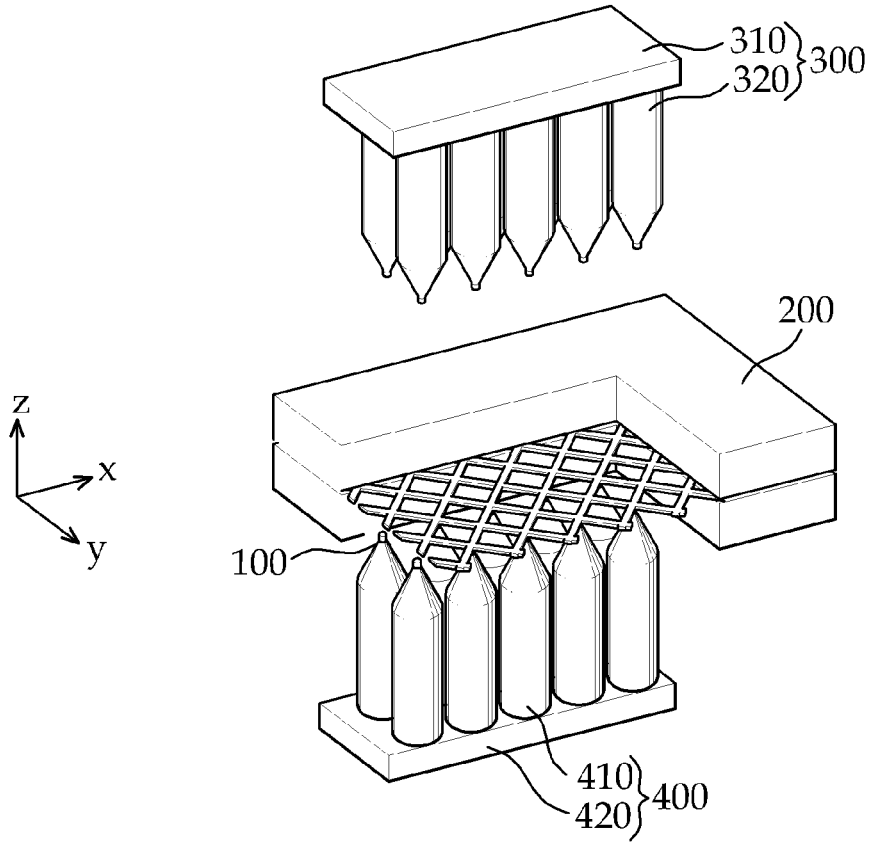
FIG. 1 is a view showing the construction of an apparatus for manufacturing a truss structure using multi-point pins, according to an embodiment of the present invention.

Hereinafter, embodiments of the present invention will be described in detail with reference to the attached drawings. It should be noted that the same reference numerals are used throughout the different drawings to designate the same or similar components as much as possible. If in the specification, detailed descriptions of well-known functions or configurations may unnecessarily make the gist of the present invention obscure, the detailed descriptions will be omitted.

FIG. 1 is a view showing the construction of an apparatus for manufacturing a truss structure using multi-point pins, according to an embodiment of the present invention.

As shown in FIG. 1, the truss structure manufacturing apparatus using multi-point pins according to an embodiment of the present invention includes a metal plate 100, clamps 200, an upper die 300 and a lower die 400.

The metal plate 100 includes an outer frame 110 which forms the outer edge of the metal plate 100, and a plurality of perforations 120 which are formed inside the outer frame 110 and have the same shape.

The metal plate 100 has a plurality of first points 130 at positions which vertically correspond to upper multi-point pins 320 of the upper die 300 that will be explained later. The metal plate 100 further has a plurality of second points 140 at positions which vertically correspond to lower multi-point pins 420 of the upper die 400 that will be explained later.

Here, the perforations 120 which are formed inside the outer frame 110 of the metal plate 100 are connected to each other by the first points 130 and the second points 140.

Figure 2A:
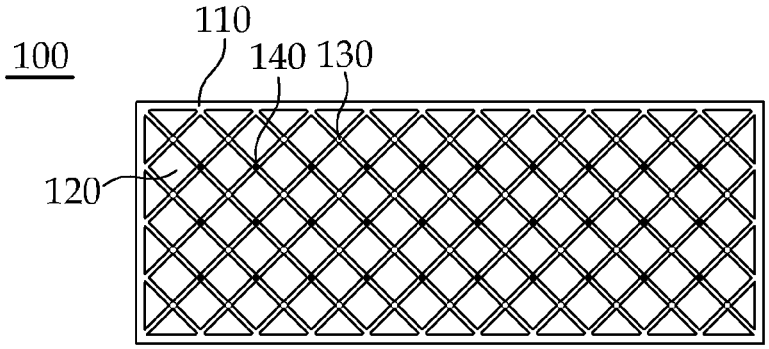
FIGS. 2A through 2C are views showing examples of a metal plate of the truss structure manufacturing apparatus according to an embodiment of the present invention.
Figure 2B:
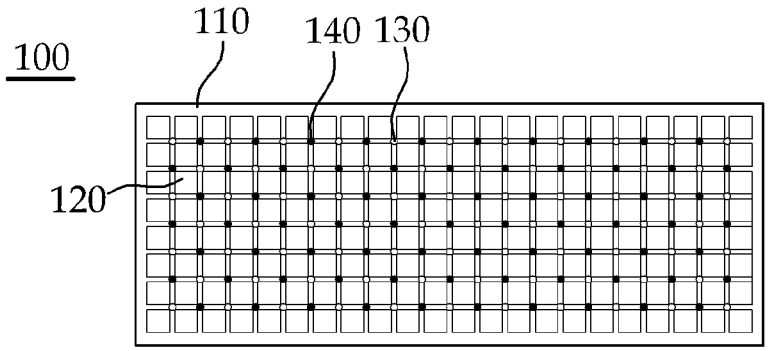
Figure 2C:
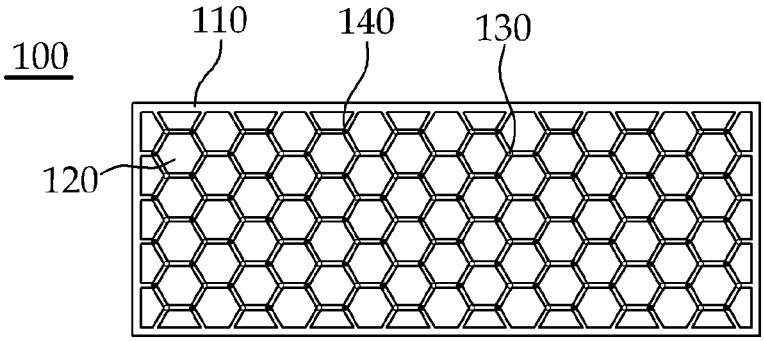

FIG. 2A through 2C are views showing examples of a metal plate of the truss structure manufacturing apparatus according to some embodiments of the present invention.

As shown in FIG. 2A, each perforation 120 may have a rhombus shape. Alternatively, as shown in FIG. 2B, each perforation 120 may have a square shape. As shown in FIG. 2C, each perforation 120 may have a hexagonal shape.

Furthermore, although not in the drawings, each perforation 120 may have other kinds of polygonal shapes, for example, a triangular shape, etc. As such, the perforations 120 of the metal plate 100 used in the present invention can assume a variety shapes.

The clamps 200 are used to clamp the upper and lower sides of the outer frame 110 of the metal plate 100 to hold the metal plate 100, thus preventing the metal plate 100 from any undesirable motion.

The upper die 300 includes an upper plate 310 and the upper multi-point pins 320 which are provided under the lower surface of the upper plate 310.

The upper multi-point pins 320 are arranged in series in rows and columns. When the upper die 300 vertically moves downwards, the upper multi-point pins 320 press the upper surface of the metal plate 100, in particular, the upper surfaces of the respective first points 130 of the metal plate 100.

FIG. 3A through 3D are views illustrating embodiments of the upper die 300 of the truss structure manufacturing apparatus using the multi-point pins according to some embodiments of the present invention.

Figure 3A:
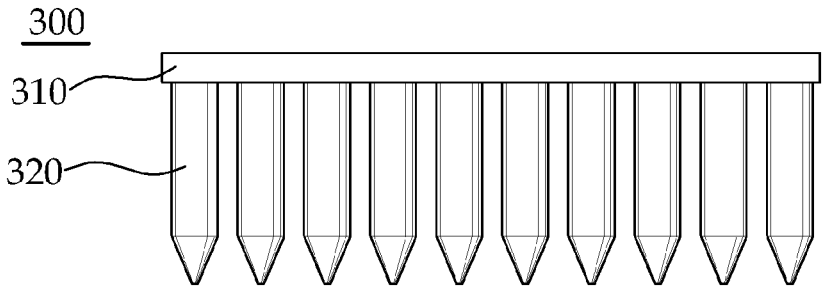
FIGS. 3A through 3D are views illustrating examples of an upper die of the truss structure manufacturing apparatus using the multi-point pins according to an embodiment of the present invention.
Figure 3B:
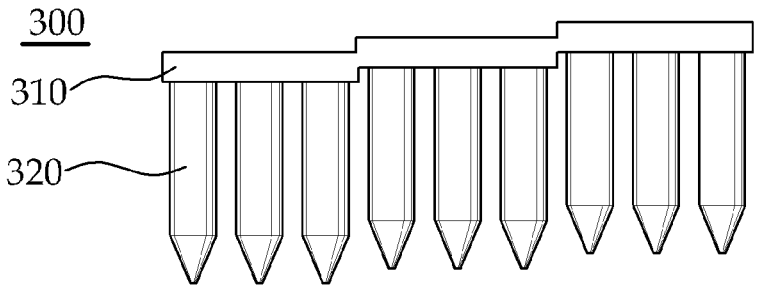
Figure 3C:
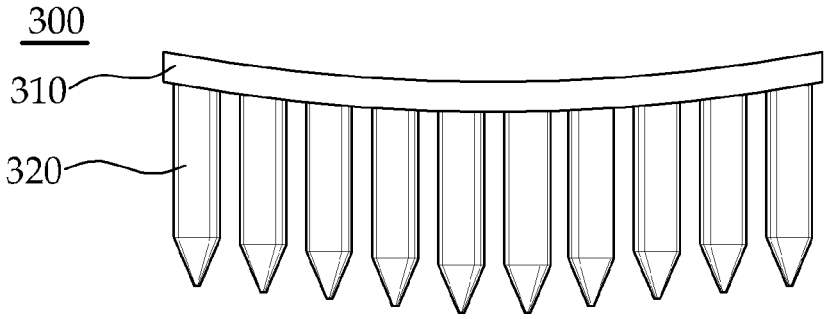

As shown in FIG. 3A, the upper plate 310 may have a planar shape or, alternatively, it may have a stepped shape, as shown in FIG. 3B. As a further alternative, as shown in FIG. 3C, the upper plate 310 may have a curved shape that is convex downwards. The upper multi-point pins 320 are arranged in the x- and y-axis directions and can be arranged in a variety of shapes depending on the shape of a truss core.

As shown in FIG. 3A, if the shape of the upper plate 310 is planar, the ends of the upper multi-point pins 320 are level with each other. As shown in FIG. 3B, if the shape of the upper plate 310 is a stepped shape or, as shown in FIG. 3C, a curved shape, the heights of the ends of the upper multi-point pins 320 differ from each other.

Figure 3D:
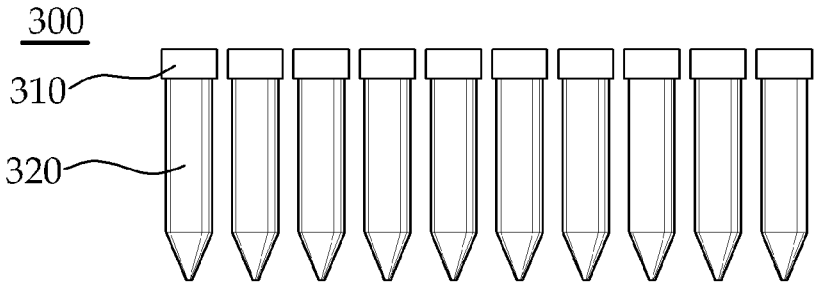

Meanwhile, as shown in FIG. 3D, the upper plate 310 may comprises a plurality of upper plates 310 which individually support the respective upper multi-point pins 320. In this case, the end of each upper multi-point pin 320 can be individually adjusted by adjusting the height of the corresponding upper plate 310.

The lower die 400 includes a lower plate 410 and the lower multi-point pins 420 which are provided on the upper surface of the lower plate 410.

The lower multi-point pins 420 are arranged in series in rows and columns. When the lower die 400 vertically moves upwards, the lower multi-point pins 420 press the lower surface of the metal plate 100.

Meanwhile, the lower multi-point pins 420 are arranged in such a way that they have x-, y- and z-coordinates different from those of the upper multi-point pins 320 described above. Thus, the first points 130 of the metal plate 100 can be extended downwards by the upper multi-point pins 320, while the second points 140 of the metal plate 100 can be extended upwards by the lower multi-point pins 420.

FIGS. 4A through 4D are views illustrating embodiments of the lower die 400 of the truss structure manufacturing apparatus using the multi-point pins according to embodiments of the present invention.

Figure 4A:
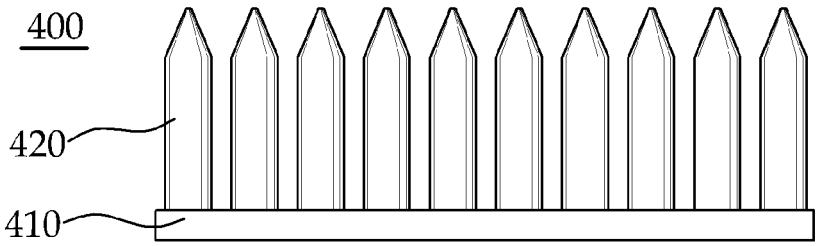
FIGS. 4A through 4D are views illustrating examples of a lower die of the truss structure manufacturing apparatus using the multi-point pins according to an embodiment of the present invention.
Figure 4B:
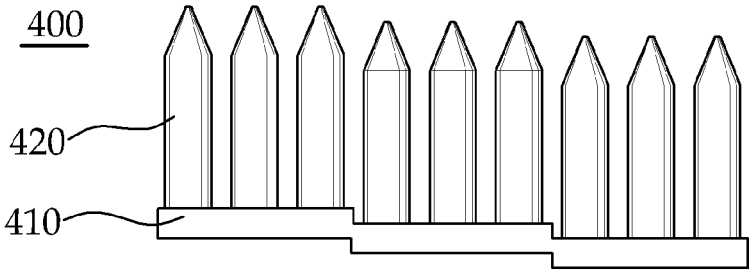
Figure 4C:
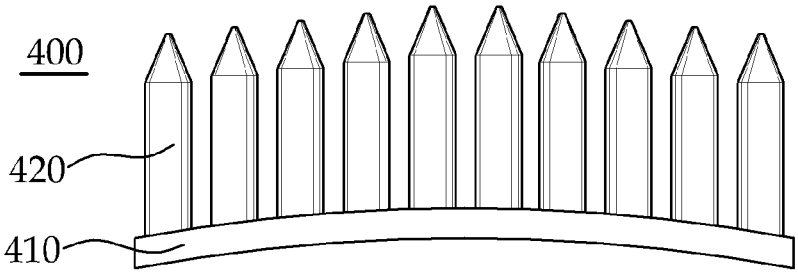

In the same manner as the upper plate 310, as shown in FIG. 4A, the lower plate 410 may have a planar shape or, alternatively, it may have a stepped shape like that shown in FIG. 4B. As a further alternative, as shown in FIG. 4C, the upper plate 410 may have a curved shape that is convex upwards. The lower multi-point pins 420 are arranged in the x- and Y-axis directions and can be arranged in a variety of shapes depending on the shape of a truss core.

As shown in FIG. 4A, if the lower plate 410 has a planar shape, the ends of the lower multi-point pins 420 are level with each other. As shown in FIG. 4B, if the lower plate 410 has a stepped shape or, as shown in FIG. 4C, a curved shape, the heights of the ends of the lower multi-point pins 420 differ from each other.

Figure 4D:
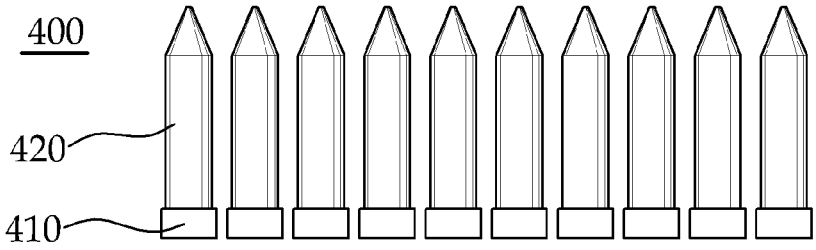

Meanwhile, in the same manner as the upper plate 310, as shown in FIG. 4D, the lower plate 410 may comprise a plurality of lower plates 410 which individually support the respective lower multi-point pins 420. In this case, the end of each lower multi-point pins 420 can be individually adjusted by adjusting the height of the corresponding lower plate 410.

Hereinafter, a process of manufacturing a truss structure using the truss structure manufacturing apparatus according to an embodiment of the present invention will be described in detail.

To manufacture a truss structure using the truss structure manufacturing apparatus according to an embodiment of the present invention, the upper die 300 and the lower die 400 are vertically moved to the metal plate 100.

Then, the first points 130 are extended downwards by the pressure application of the upper multi-point pins 320 of the upper die 300, while the second points 140 are extended upwards by the pressure exerted by the lower multi-point pins 420 of the lower die 400. Thereby, the metal plate 100 may be shaped such that a plurality of sides that are symmetrical based on the first and second points 130 and 140 are formed. Therefore, a truss structure of a stable shape can be manufactured.

Figure 5A:
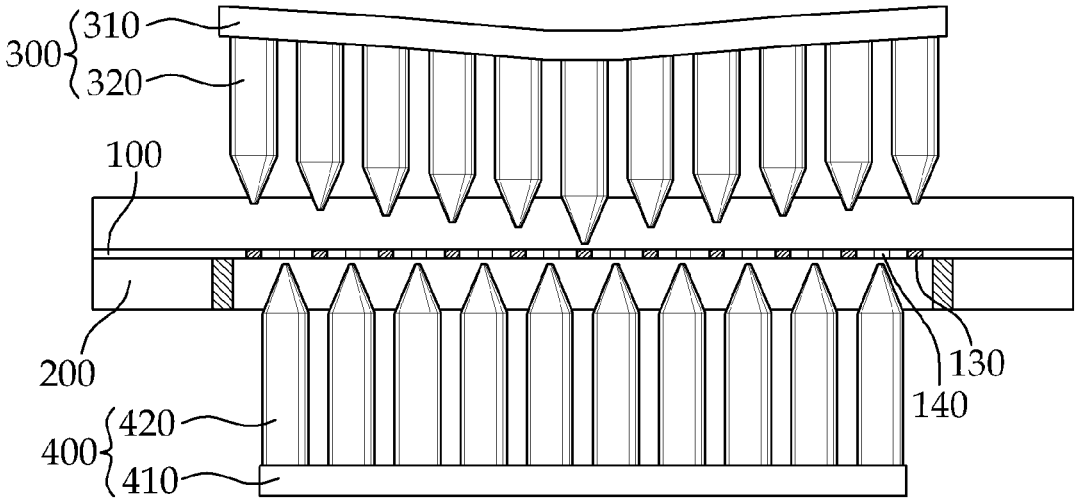
FIGS. 5A and 5B are views showing a process of manufacturing a truss structure using the truss structure manufacturing apparatus according to an embodiment of the present invention.
Figure 5B:
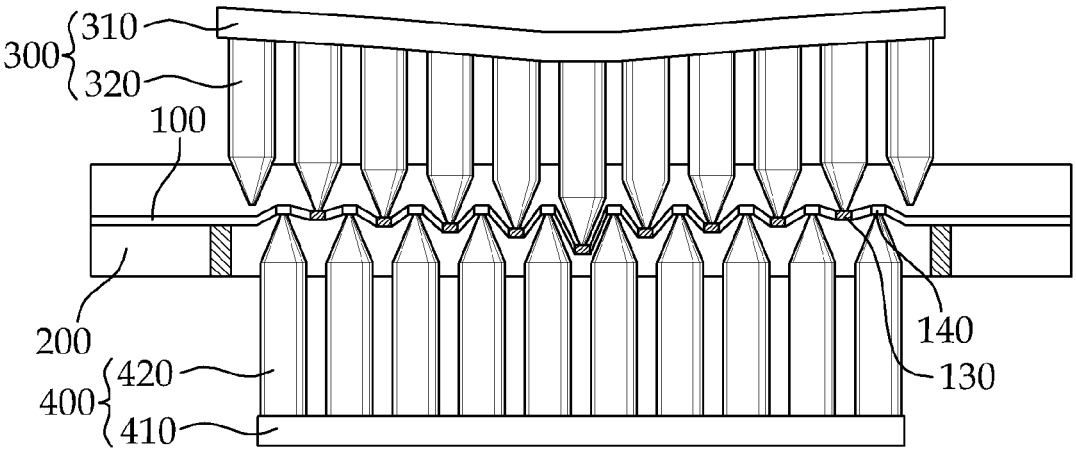
Figure 6:
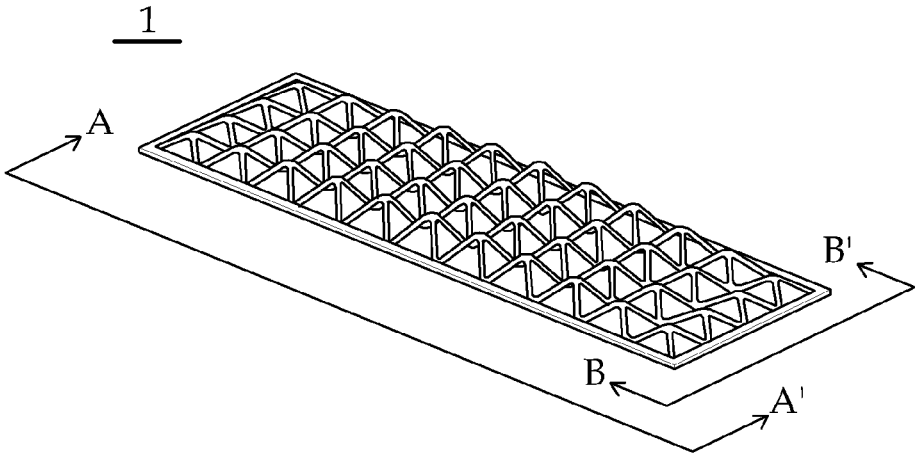
FIG. 6 is a view showing the truss structure manufactured by the truss structure manufacturing apparatus according to an embodiment of the present invention.
Figure 7A:
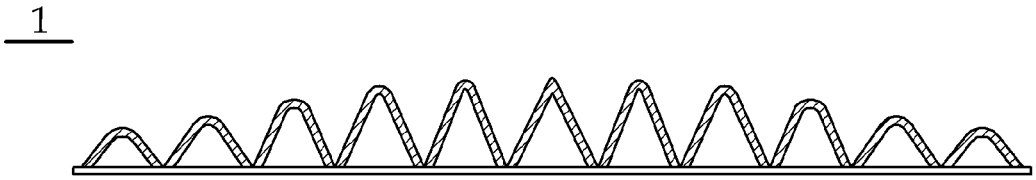
FIG. 7A is a view showing the truss structure from the direction indicated by line A-A' of FIG. 6.
Figure 7B:
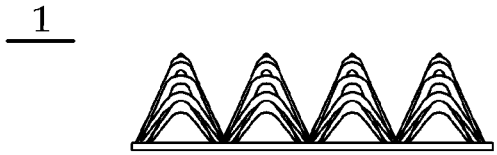
FIG. 7B is a view showing the truss structure from the direction indicated by line B-B' of FIG. 6.

FIGS. 5A and 5B are views showing a process of manufacturing a truss structure using the truss structure manufacturing apparatus according to some embodiments of the present invention FIG. 6 is a view showing the truss structure manufactured by the truss structure manufacturing apparatus according to an embodiment of the present invention. FIG. 7A is a view showing the truss structure from the direction indicated by line A-A' of FIG. 6. FIG. 7B is a view showing the truss structure from the direction indicated by line B-B' of FIG. 6.

As shown in FIGS. 5A and 5B, if the upper plate 310 of the upper die 300 has a curved shape that is convex downwards and the lower plate 410 of the lower die 400 has a planar shape, the upper multi-point pins 320 that are located on the medial portion of the upper plate 310 push the corresponding first points 130 downwards by a distance that is longer than the upper multi-point pins 320 that are located on both ends of the upper plate 310 do. The lower multi-point pins 420 of the lower plate 410 push the corresponding second points 140 upwards by the same distance. Therefore, as shown in FIGS. 6 through 7B, a truss structure 1 can be produced, in which the degree to which the structure is deformed increases from both ends thereof to the medial portion.

Hereinafter, a method of manufacturing a truss structure using multi-point pins according to an embodiment of the present invention will be described.

Figure 8:
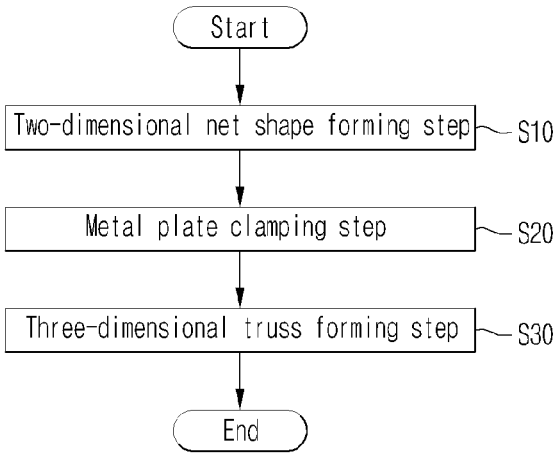
FIG. 8 is a block diagram of a method of manufacturing a truss structure using multi-point pins, according to an embodiment of the present invention.
Figure 9A:
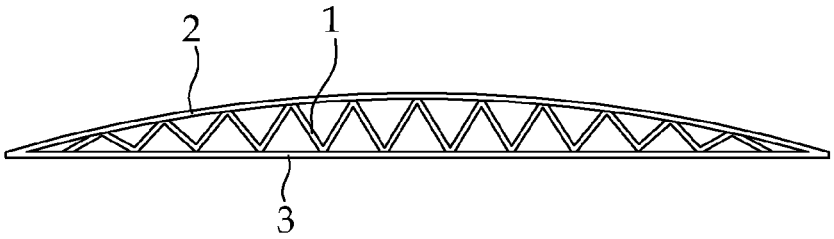
FIGS. 9A through 9D are views showing examples of a truss core sandwich panel manufactured by using multi-point pins, according to an embodiment of the present invention.
Figure 9B:
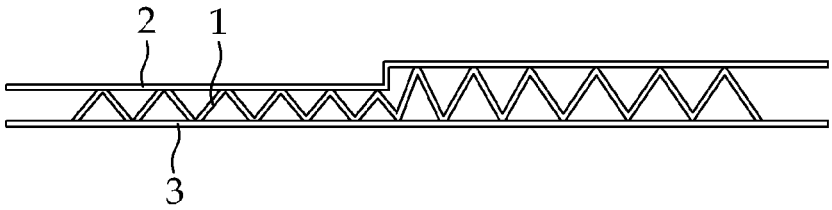
Figure 9C:
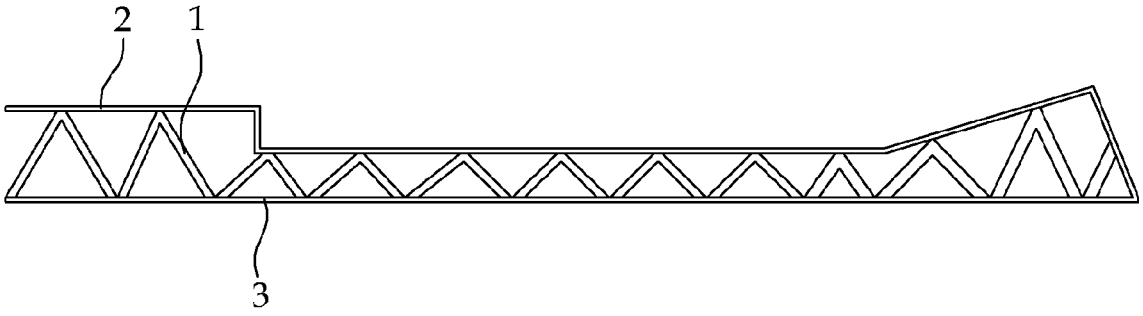
Figure 9D:
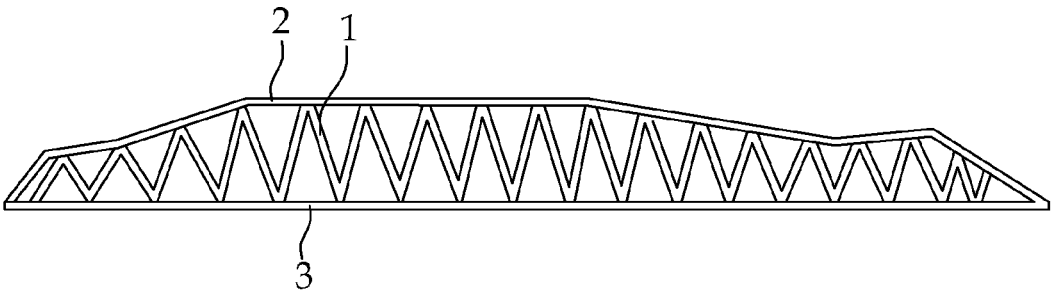

FIG. 8 is a block diagram of the method of manufacturing a truss structure using the multi-point pins according to some embodiments of the present invention.

As shown in FIG. 8, the method of manufacturing a truss structure using the multi-point pins according to some embodiments of the present invention includes a two-dimensional net shape forming step S10, a metal plate clamping step S20 and a three-dimensional truss forming step S30.

As shown in FIG. 1, the two-dimensional net shape forming step S10 includes forming perforations 120 of the same shape in the metal plate 100.

Different kinds of methods can be used to form the perforations 120 in the metal plate 100, examples of which are blanking, laser machining, water jet machining, electrical discharge machining, etc. As shown in FIGS. 2A through 2C, each perforation 120 may have a rhombus shape, a square shape or a hexagonal shape.

The metal plate clamping step S20 includes holding the metal plate 100 by pressing the upper and lower sides of the outer frame 110 of the metal plate 100 using the clamps 200.

The three-dimensional truss forming step S30 includes pressing the metal plate 100 using the upper die 300 and the lower die 400 of the truss structure manufacturing apparatus according to an embodiment of the present invention to thus form the truss structure.

In detail, as shown in FIGS. 5A and 5B, at the three-dimensional truss forming step S30, the upper multi-point pins 320 of the upper die 300 press the first points 130 of the metal plate 100 to extend the first points 130 downwards. The lower multi-point pins 420 of the lower die 400 simultaneously press the second points 140 of the metal plate 100 to extend the second points 140 upwards. Thereby, a truss structure can be produced that has a stable shape in which the plurality of sides that are formed are symmetrical around the first and second points 130 and 140.

Hereinafter, a truss core sandwich panel manufactured by the multi-point pins according to an embodiment of the present invention will be explained in detail.

FIGS. 9A through 9D are views showing examples of a truss core sandwich panel manufactured by using the multi-point pins, according to an embodiment of the present invention.

The truss core sandwich panel manufactured by using the multi-point pins according to an embodiment of the present invention includes a truss structure 1, an upper panel 2, a lower panel 3 and a bonding means (not shown).

As shown in FIGS. 9A through 9D, the truss structure 1 can be manufactured in a variety of shapes by adjusting the heights of the multi-point pins in the truss structure manufacturing method using the multi-point pins according to some embodiments of the present invention. The truss structure 1 forms an intermediate layer of the truss core sandwich panel.

The upper panel 2 is disposed on the upper side of the truss structure 1, and the lower panel 3 is disposed under the lower side of the truss structure 1.

The bonding means (not shown) bonds upper and lower ends of the truss structure 1 to the upper and lower panels 2 and 3.

Of course, brazing, welding, resin bonding, electric resistance welding, etc. can be used as the method of bonding the truss structure 1 to the upper and lower panels 2 and 3.

Meanwhile, in the truss core sandwich panel according to an embodiment of the present invention, a three-dimensional porous structure may be formed by stacking only the truss structures 1 one on top of another in a two or more layered shape. Alternatively, a multi-layered sandwich panel structure may be formed by stacking the truss core sandwich panels one on top of another in a two or more layered shape.

Hereinafter, a method of manufacturing a truss core sandwich panel using multi-point pins according to an embodiment of the present invention will be described in detail.

Figure 10:
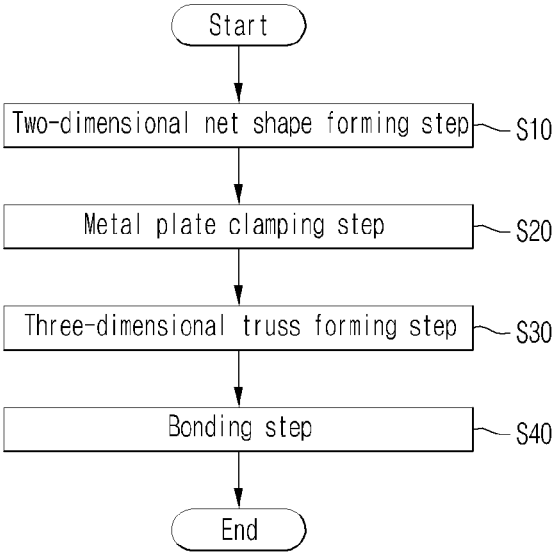
FIG. 10 is a block diagram of a method of manufacturing a truss core sandwich panel using multi-point pins, according to an embodiment of the present invention.

FIG. 10 is a block diagram of the method of manufacturing a truss core sandwich panel using multi-point pins according to an embodiment of the present invention.

As shown in FIG. 10, the method of manufacturing a truss core sandwich panel using multi-point pins according to an embodiment of the present invention includes a two-dimensional net shape forming step S10, a metal plate clamping step S20, a three-dimensional truss forming step S30 and a bonding step S40.

The two-dimensional net shape forming step S10, the metal plate clamping step S20 and the three-dimensional truss forming step S30 are conducted in the same manner as the two-dimensional net shape forming step, the metal plate clamping step and the three-dimensional truss forming step of the truss structure manufacturing method described above.

The bonding step S40 includes disposing the upper panel 2 and the lower panel 3 on and under the upper and lower sides of the truss structure 1 formed during the three-dimensional truss forming step S30, and bonding upper and lower ends of the truss structure 1 to the upper panel 2 and the lower panel 3 using the bonding means (not shown).

As described above, the present invention in its various embodiments provides an apparatus for manufacturing a truss structure using multi-point pins, a method of manufacturing a truss structure using the apparatus, a truss core sandwich panel having the truss structure, and a method of manufacturing the truss core sandwich panel. In some embodiments of the present invention, the heights of the multi-point pins can be adjusted so that different shapes of truss core sandwich panels can be manufactured. Strain hardening by a tensioning process can enhance the strength and rigidity of the structure. In addition, the structural stability of the structure can be enhanced by increasing the number of symmetrical sides of the structure. Further, a material recovery rate can be markedly increased, compared to that of the conventional technique.

Although embodiments of an apparatus for manufacturing a truss structure using multi-point pins, a method of manufacturing a truss structure using the apparatus, a truss core sandwich panel having the truss structure, and a method of manufacturing the truss core sandwich panel according to the present invention have been described with reference to the drawings, the present invention is not limited to the embodiments and drawings disclosed in the specification. Those skilled in the art will appreciate that various modifications, additions and substitutions are possible, without departing from the scope and spirit of the invention as disclosed in the accompanying claims.

What is claimed is:

1. A method of manufacturing a truss structure using multi-point pins, comprising:

providing an apparatus for manufacturing a truss structure using multi-point pins, the apparatus comprising:

a metal plate having an outer frame and a plurality of perforations formed inside the outer frame, the perforations having a same shape;

clamps pressing upper and lower sides of the outer frame to hold the metal plate;

an upper die comprised of an upper plate; and a plurality of upper multi-point pins arranged under a lower surface of the upper plate in series in rows and columns, the upper die pressing the metal plate downwards; and a lower die comprised of a lower plate; and a plurality of lower multi-point pins arranged on an upper surface of the lower plate in series in rows and columns, the lower die pressing the metal plate upwards, wherein the metal plate comprises a plurality of first points formed at positions that vertically correspond to the upper multi-point pins, and a plurality of second points formed at positions that vertically correspond to the lower multi-point pins, the first points being extended downwards by pressure applied thereto from the upper multi-point pins, and the second points being extended upwards by pressure applied thereto from the lower multi-point pins;

wherein heights of ends of the upper multi-point pins differ from each other or heights of ends of the lower multi-point pins differ from each other; machining the metal plate in a two-dimensional net shape by forming perforations having a same shape in the metal plate;

clamping the metal plate by pressing upper and lower sides of an outer frame of the metal plate using clamps; and forming the truss structure having a three-dimensional shape through application of pressure to the metal plate using the upper die and the lower die of the apparatus to extend the first points of the metal plate downwards using the upper multi-point pins of the upper die and to extend the second points of the metal plate upwards using the lower multi-point pins.

2. The method as set forth in claim 1, wherein the upper plate or the lower plate has a stepped shape.

3. The method as set forth in claim 1, wherein the upper plate has a curved shape or the lower plate has a curved shape so that heights of ends of the upper multi-point pins or.

4. The method as set forth in claim 1, wherein the upper plate comprises a plurality of upper plates supporting the respective upper multi-point pins, or the lower plate comprises a plurality of lower plates supporting the respective lower, whereby heights of ends of the upper multi-point pins or lower multi-point pins are individually adjusted.

5. The method as set forth in claim 1, wherein each of the perforations has a rhombic shape.

6. The method as set forth in claim 1, wherein each of the perforations has a rectangular shape.

7. The method as set forth in claim 1, wherein each of the perforations has a hexagonal shape.

8. The method as set forth in claim 1, wherein each of the perforations has a triangular shape.

9. A method of manufacturing a truss core sandwich panel using multi-point pins, comprising:

providing an apparatus for manufacturing a truss structure using multi-point pins, the apparatus comprising:

a metal plate having an outer frame and a plurality of perforations formed inside the outer frame, the perforations having a same shape;

clamps pressing upper and lower sides of the outer frame to hold the metal plate;

an upper die comprised of an upper plate; and a plurality of upper multi-point pins arranged under a lower surface of the upper plate in series in rows and columns, the upper die pressing the metal plate downwards; and a lower die comprised of a lower plate; and a plurality of lower multi-point pins arranged on an upper surface of the lower plate in series in rows and columns, the lower die pressing the metal plate upwards, wherein the metal plate comprises a plurality of first points formed at positions that vertically correspond to the upper multi-point pins, and a plurality of second points formed at positions that vertically correspond to the lower multi-point pins, the first points being extended downwards by pressure applied thereto from the upper multi-point pins, and the second points being extended upwards by pressure applied thereto from the lower multi-point pins;

wherein heights of ends of the upper multi-point pins differ from each other or heights of ends of the lower multi-point pins differ from each other; machining the metal plate in a two-dimensional net shape by forming perforations having a same shape in the metal plate;

clamping the metal plate by pressing upper and lower sides of an outer frame of the metal plate using clamps; and forming the truss structure having an upper side, a lower side and a three-dimensional shape through application of pressure to the metal plate using the upper die and the lower die of the apparatus to extend the first points of the metal plate downwards using the upper multi-point pins of the upper die and to extend the second points of the metal plate upwards using the lower multi-point pins;

disposing the truss structure between an upper panel and a lower panel; and bonding upper and lower sides of the truss structure respectively to the upper panel and the lower panel.

* * * * *